US010138425B2

(12) United States Patent
Ward et al.

(10) Patent No.: US 10,138,425 B2
(45) Date of Patent: Nov. 27, 2018

(54) DELAYED COKE DRUM QUENCH SYSTEMS AND METHODS HAVING REDUCED ATMOSPHERIC EMISSIONS

(71) Applicant: Bechtel Hydrocarbon Technology Solutions, Inc., Houston, TX (US)

(72) Inventors: John D. Ward, Katy, TX (US); Richard Heniford, Katy, TX (US); Scott Alexander, Billings, MT (US)

(73) Assignee: Bechtel Hydrocarbon Technology Solutions, Inc., Houston, TX (US)

( * ) Notice: Subject to any disclaimer, the term of this patent is extended or adjusted under 35 U.S.C. 154(b) by 0 days.

(21) Appl. No.: 15/310,683

(22) PCT Filed: Apr. 8, 2016

(86) PCT No.: PCT/US2016/026699
§ 371 (c)(1),
(2) Date: Nov. 11, 2016

(87) PCT Pub. No.: WO2017/052692
PCT Pub. Date: Mar. 30, 2017

(65) Prior Publication Data

US 2018/0187086 A1 Jul. 5, 2018

Related U.S. Application Data

(60) Provisional application No. 62/221,501, filed on Sep. 21, 2015.

(51) Int. Cl.

| | |
|---|---|
| ***C10B 55/00*** | (2006.01) |
| ***C10G 9/00*** | (2006.01) |
| ***C10B 39/04*** | (2006.01) |

(52) U.S. Cl.
CPC ..... *C10B 39/04* (2013.01); *C10B 55/00* (2013.01); *C10G 9/005* (2013.01)

(58) Field of Classification Search
CPC ..... C10B 55/00; C10B 55/02; C10B 55/04; C10B 55/06; C10B 55/08; C10B 55/10; C10G 9/005
See application file for complete search history.

(56) References Cited

U.S. PATENT DOCUMENTS 3,248,321 A 4/1966 Fagan
3,257,309 A 6/1966 Fauchier et al.
(Continued)

FOREIGN PATENT DOCUMENTS

GB 1223786 A 3/1971

OTHER PUBLICATIONS

Shane Thomas, International Search Report and Written Opinion of the International Searching Authority, Application No. PCT/US16/26699, dated Jul. 12, 2016, 7 pages, International Searching Authority, US.

(Continued)

*Primary Examiner* — Jonathan Miller
*Assistant Examiner* — Jonathan Luke Pilcher
(74) *Attorney, Agent, or Firm* — Crain, Caton & James

(57) ABSTRACT

Systems and methods for reducing atmospheric emission of hydrocarbon vapors by flashing off hydrocarbon vapors in an overflow drum where the pressure is ultimately reduced to 0 psig and then flashing off any remaining hydrocarbon vapors in an overflow tank wherein the pressure in the overflow tank is reduced to 0 psig by an overflow ejector.

14 Claims, 3 Drawing Sheets

(56) References Cited

U.S. PATENT DOCUMENTS

| | | | | |
|---|---|---|---|---|
| 3,917,564 | A | 11/1975 | Meyers | |
| 4,100,035 | A | 7/1978 | Smith | |
| 4,834,864 | A | 5/1989 | Mayer et al. | |
| 4,968,407 | A * | 11/1990 | McGrath | C10B 55/00 201/25 |
| 5,110,448 | A | 5/1992 | Adams | |
| 5,415,673 | A | 5/1995 | Hilton | |
| 5,645,711 | A | 7/1997 | Hraban et al. | |
| 6,919,017 | B2 | 7/2005 | Annesley et al. | |
| 7,419,608 | B2 | 9/2008 | Wang et al. | |
| 9,187,696 | B2 * | 11/2015 | Ward | C10B 45/00 |
| 2004/0173504 | A1 * | 9/2004 | Klasnich | C10B 55/00 208/131 |
| 2010/0270208 | A1 | 10/2010 | Ward | |
| 2011/0209406 | A1 | 9/2011 | Chinnadurai | |
| 2012/0193093 | A1 | 8/2012 | James | |
| 2014/0262724 | A1 | 9/2014 | Ward | |
| 2014/0311885 | A1 | 10/2014 | Wilborn | |

OTHER PUBLICATIONS

Blaine R Copenheaver, Notice of Transmittal of the International Search Report and The Written Opinion of the International Searching Authority, International Application No. PCT/US2014/028878, dated Jul. 29, 2014, 11 pages, International Searching Authority, Alexandria, Virginia.

Jill Warden, Notification of Transmittal of International Preliminary Report on Patentability, International Application No. PCT/US2014/026878, dated Jan. 22, 2015, 7 pages, International Preliminary Examining Authority, Alexandria, Virginia.

Search Report for Patent Application, ROC (Taiwan) Patent Application No. 105130514, dated Jul. 9, 2017, 1 page, Taiwan.

Kihwan Moon, International Preliminary Report on Patentability, PCT Application No. PCT/US2016/026699, dated Apr. 5, 2018, 6 pages, International Bureau of WIPO, Geneva Switzerland.

* cited by examiner

DELAYED COKE DRUM QUENCH SYSTEMS AND METHODS HAVING REDUCED ATMOSPHERIC EMISSIONS

CROSS-REFERENCE TO RELATED APPLICATIONS

The priority of PCT Patent Application No. PCT/US2016/0026699, filed on Apr. 8, 2016, which claims the benefit of U.S. Provisional Application 62/221,501, filed on Sep. 21, 2015, is hereby claimed, and the specification thereof is incorporated herein by reference.

FIELD OF THE DISCLOSURE

The present disclosure generally relates to delayed coking drum quench systems and methods having reduced atmospheric emissions. More particularly, the present disclosure relates to reducing atmospheric emissions of hydrocarbon vapors by flashing off hydrocarbon vapors in an overflow drum wherein the pressure is reduced by an overhead ejector to 0 psig, and where any remaining hydrocarbon vapors are flashed off through the overflow ejector to the blowdown condenser.

BACKGROUND

Coking is one of the older refining processes. The purpose of a delayed coking plant is to convert heavy residual oils (e.g. tar, asphalt, etc.) into lighter, more valuable motor fuel blending stocks. Refinery coking is controlled, severe, thermal cracking. It is a process in which the high molecular weight hydrocarbon residue (normally from the bottoms of the vacuum flasher in a refinery crude unit) are cracked or broken up into smaller and more valuable hydrocarbons.

Coking is accomplished by subjecting the feed charge to an extreme temperature of approximately 930° F. that initiates the cracking process. The light hydrocarbons formed as a result of the cracking process flash off and are separated in conventional fractionating equipment. The material that is left behind after cracking is coke, which is mostly carbon. In addition to coke, which is of value in the metal industry in the manufacture of electrodes, fuel coke, titanium dioxide, etc., the products of a delayed coking plant include gas (refinery fuel gas), liquefied petroleum gas, naphtha, light gas oil, and heavy gas oil.

Most of the world's coking capacity is generated by delayed coking processes. Delayed coking can be thought of as a continuous batch reaction. The process makes use of paired coke drums. One drum (the active drum) is used as a reaction vessel for the thermal cracking of residual oils. This active drum slowly fills with coke as the cracking process proceeds. While the active drum is being filled with coke, a second drum (the inactive drum) is in the process of having coke removed from it. The coke drums are sized so that by the time the active drum is filled with coke, the inactive drum is empty. The process flow is then switched to the empty drum, which becomes the active drum. The full drum becomes the inactive drum and is emptied or decoked. By switching the process flow back and forth between the two drums in this way, the coking operation can continue uninterrupted.

In operation, after being heated in a direct-fired furnace, the oil is charged to the bottom of the active coke drum. The cracked light hydrocarbons rise to the top of the drum where they are removed and charged to a fractionator for separation. The heavier hydrocarbons are left behind, and the retained heat causes them to crack to coke.

In FIG. 1, a schematic diagram illustrates one example of a delayed coking closed blowdown system (hereinafter "delayed coking quench system"), where the effluent from the inactive drum is processed. The quenching of the inactive coke drum produces large quantities of steam with some hydrocarbons which are processed in this system.

A quench tower 106, a blowdown condenser 122 and a settling drum 124 form a closed blowdown system, which is used to recover effluent from the coke drum steaming, quenching and warming operations.

In conventional systems, a blowdown header line 104 communicates the hot vapor from a coke drum overhead line 101 to a quench tower 106 during the steaming and water quenching operation.

Just upstream of the quench tower 106, the hot vapor is quenched by a controlled injection of water from the process. During the water quenching operation, the overhead stream from the quench tower 106, is substantially steam with small amounts of hydrocarbons, and is sent in an overhead line 120 to the blowdown condenser 122.

The blowdown condenser 122 condenses the bulk of the overhead stream to form a blowdown condenser outlet stream which is communicated in the blowdown condenser outlet stream line 123 to a blowdown settling drum 124.

In the settling drum 124, the blowdown condenser outlet stream is separated into a sour water stream 126, a light slop oil stream 132 and a hydrocarbon vapor stream 127. The hydrocarbon vapor stream 127 is sent to the blowdown ejector 158 and then to the fractionator overhead system 160. The light slop oil stream 132 is returned to the quench tower 106. The blowdown ejector 158 is used to reduce the pressure in the closed blowdown system and coke drum at the end of the water quench prior to isolating a coke drum and venting the coke drum to atmosphere. Alternatively, a compressor may be used in place of a blowdown ejector 158. The blowdown ejector, which may be steam-driven, is used to target 2 psig before venting the drum to atmosphere. Effluent from blowdown ejector 158 is sent to the fractionator overhead system 160, and recovered to the main process.

A quench water tank 140 is used to provide water to quench water line 148 and to the coke cutting line 142.

During the quench operation the inactive coke drum is connected to the closed blowdown system and the pressure in the inactive coke drum is essentially the same as the pressure in the closed blowdown system. At the end of the quench operation, the inactive coke drum is isolated from the closed blowdown system and is vented to the atmosphere. An ejector or small compressor may be used in a line containing the hydrocarbon vapor stream 127 to reduce the pressure in the closed blowdown system and inactive coke drum to about 2 psig or less prior to isolating and venting the inactive coke drum as required by current environmental regulation guidelines. Despite venting the inactive coke drum to the atmosphere at 2 psig, a plume of steam is produced that may contain hydrocarbon vapors (e.g. methane, ethane, hydrogen sulfide) and coke fines (hereinafter collectively "atmospheric emissions"). Maintaining a pressure of 2 psig in the inactive coke drum prior to venting to the atmosphere is also an issue because the coke drum pressure can spike due to continuing heat evolution from the coke bed after isolation from the closed blowdown system. On some older units, which start to vent at around 15 psig, noise is also a significant issue.

It is known that a delayed coking quench system may be modified to include a coke drum quench overflow system to provide the benefit of overflowing a coke drum at the end of the quench operation. Existing overflow systems are varied and some have been known to generate undesirable odors, and gas releases or fires, plugging exchangers and residual coke fines in lines that are flushed into other equipment when the coke drums are returned to the fill cycle because the overflow stream can contain significant atmospheric emissions. In addition, many existing overflow systems do not minimize atmospheric emissions, and merely relocate the source of the atmospheric emissions.

Because some existing overflow systems have American Petroleum Institute ("API") separators or other equipment open to the atmosphere, there can be atmospheric emissions, which is a serious problem. When the overflow stream is sent through an air cooler without being properly filtered, the air cooler can plug, which is also a problem in some existing overflow systems. In parts of the piping system used by existing overflow systems, coke fines are often left after the overflow operation, which are then flushed into the quench tower or fractionator when returning to the normal valving arrangement. A delayed coking unit that produces shot coke can result in larger amounts of oil and coke fines in the quench overflow stream, which is more problematic to handle.

SUMMARY

The present disclosure therefore, meets the above needs and overcomes one or more deficiencies in the prior art by providing systems and methods for reducing atmospheric emissions of hydrocarbon vapors by flashing off hydrocarbon vapors in an overflow drum where the pressure is ultimately reduced to 0 psig and then flashing off any remaining hydrocarbon vapors in an overflow tank wherein the pressure in the overflow tank is reduced to 0 psig by an overflow ejector.

In one embodiment, the present disclosure includes a system for reducing atmospheric emissions of hydrocarbon vapors in a delayed coke drum quench overflow system, which comprises: i) an overflow drum connected to a blowdown header line for reducing hydrocarbon vapors and producing a vapor overflow remainder and a liquid overflow remainder; ii) an overflow tank connected to the overflow drum by a liquid overflow remainder line for separating at least one of skim oil, water, coke fines, and tank vapor from the liquid overflow remainder; iii) an overflow drum vapor line in fluid communication with the overflow drum for transmitting the vapor overflow remainder to a steam line; and iv) a tank vapor line in fluid communication with the overflow tank for transmitting the tank vapor to an overflow ejector, wherein the overflow ejector includes an inlet in fluid communication with the tank vapor line and an outlet in fluid communication with the steam line for reducing the pressure in the overflow tank to 0 psig.

In another embodiment, the present disclosure includes a method for reducing atmospheric emissions of hydrocarbon vapors in a delayed coke drum quench overflow system, which comprises: i) producing a vapor overflow remainder and a liquid overflow remainder from an overflow drum; ii) separating at least one of skim oil, water, coke fines, and tank vapor from the liquid overflow remainder in an overflow tank; iii) transmitting the vapor overflow remainder to a steam line; iv) transmitting the tank vapor to an inlet of an overflow ejector; and v) reducing the pressure of the overflow tank to 0 psig.

Additional aspects, advantages and embodiments of the disclosure will become apparent to those skilled in the art from the following description of the various embodiments and related drawings.

BRIEF DESCRIPTION OF THE DRAWINGS

The present disclosure is described below with references to the accompanying drawings, in which like elements are referenced with like numerals, wherein.

DETAILED DESCRIPTION

The subject matter of the present disclosures is described with specificity, however, the description itself is not intended to limit the scope of the disclosure. The subject matter thus, might also be embodied in other ways, to include different structures, steps and/or combinations similar to and/or fewer than those described herein, in conjunction with other present or future technologies. Moreover, although the term "step" may be used herein to describe different elements of methods employed, the term should not be interpreted as implying any particular order among or between various steps herein disclosed unless otherwise expressly limited by the description to a particular order. While the following description refers to delayed coking drum quench operations, the systems and methods of the present disclosure are not limited thereto and may be applied in other operations to achieve similar results.

Figure 1:
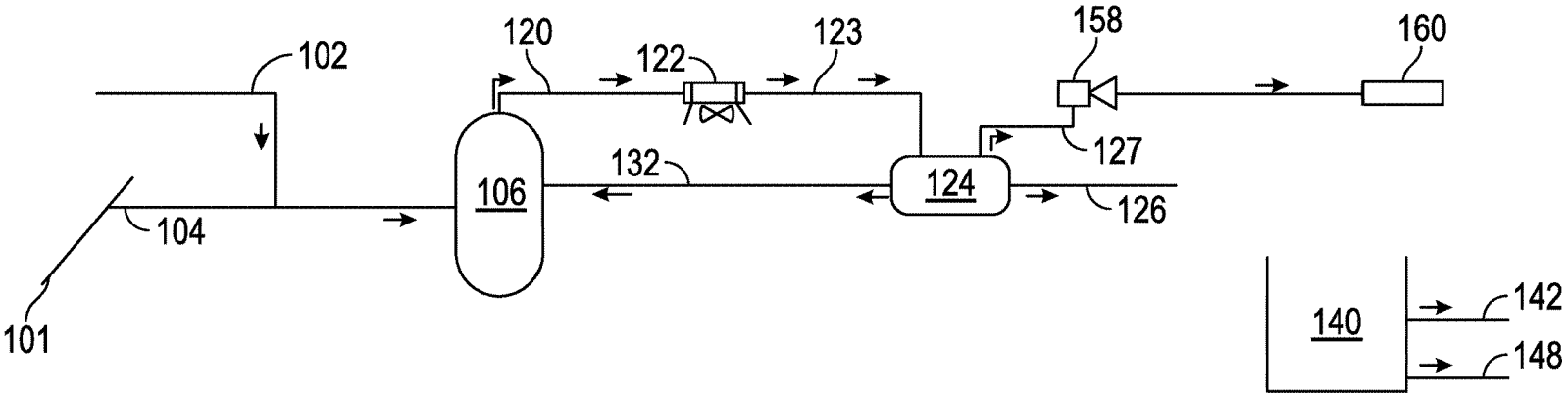
FIG. 1 is a schematic diagram illustrating one example of a conventional delayed coking quench system.
Figure 2:
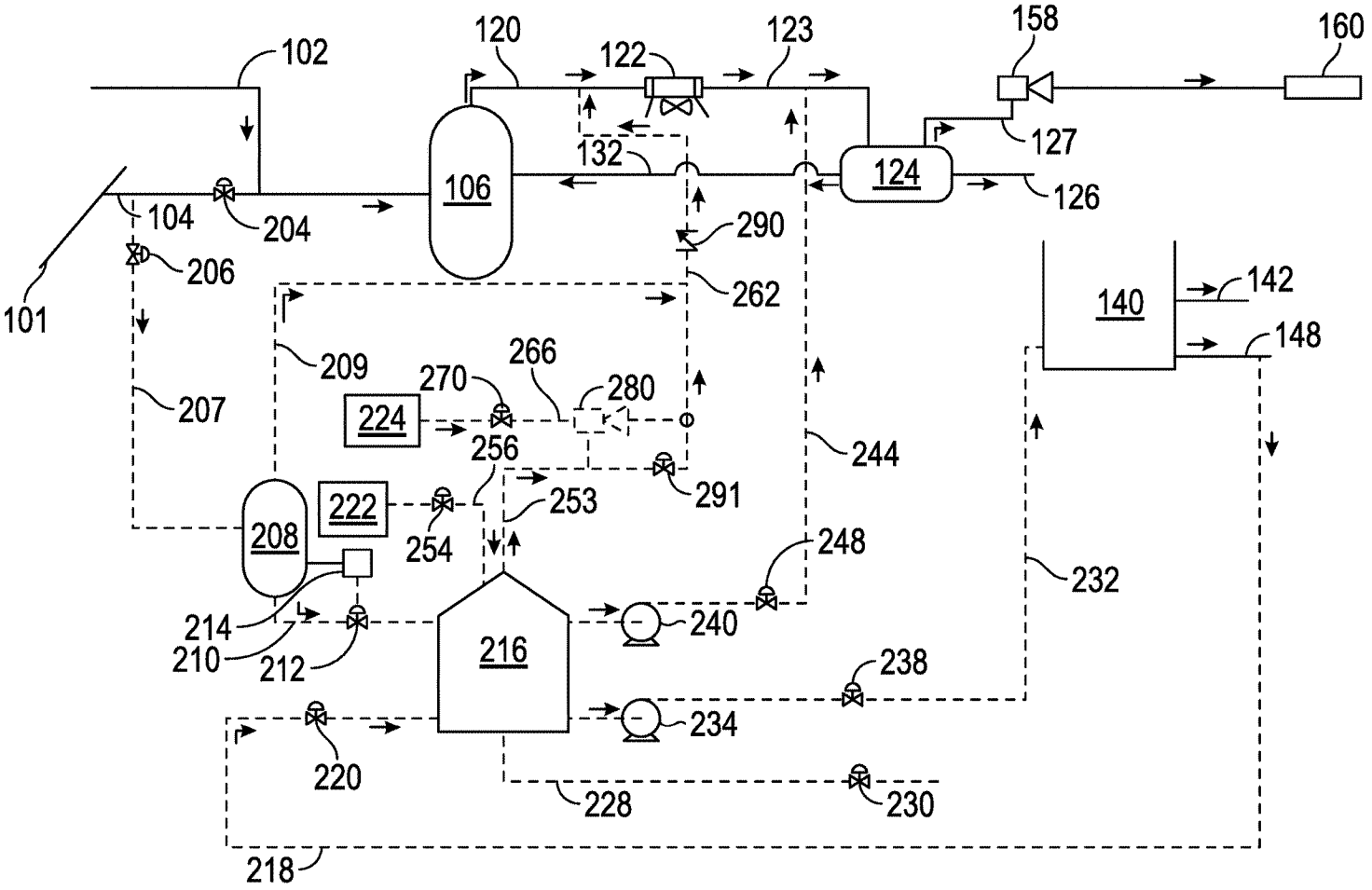
FIG. 2 is a schematic diagram illustrating a conventional delayed coking quench system and one embodiment of a delayed coking quench overflow system according to the present disclosure.

Referring now to FIG. 2, a schematic diagram illustrates a conventional delayed coking quench system and one embodiment of a delayed coking quench overflow system according to the present disclosure.

In operation, at the end of the water quench operation, water covers the coke bed in the coke drum and is allowed to overflow into an overflow drum 208 and overflow tank 216. This is accomplished when a level switch on the coke drum causes a valve 204 in the blowdown header line 104 to close and opens a supply line valve 206 in the supply line 207 to the overflow drum 208. To ensure the coke drum relief valve discharge remains operable, valve 204 is positioned upstream of the coke drum relief valve discharge 102 to the quench tower 106.

In the overflow drum 208, hydrocarbon vapors are preferably flashed off, reducing or eliminating atmospheric emissions. The overflow drum 208 is in communication with a steam/hydrocarbon vapor line 262 via an overflow drum vapor line 209, to communicate the flashed-off hydrocarbons and steam, the vapor overflow remainder, to the overhead hydrocarbon steam stream line 120 for delivery to the blowdown condenser 122 and, ultimately, the blowdown ejector 158. The overflow drum vapor line 209 is thus in fluid communication with the overflow drum 208 for transmitting the vapor overflow remainder to a steam line 262. The communication with the steam/hydrocarbon vapor line 262, which operates at 0-2 psig, ensures the overflow drum 208 likewise operates at approximately 0-2 psig, and therefore maximizes the volume of vapor overflow remainder flashed off through the blowdown condenser 122. The overflow drum 208 is thus connected to a blowdown header line 104 for reducing hydrocarbon vapors and producing a vapor overflow remainder and a liquid overflow remainder.

A liquid overflow remainder line 210 in communication with the bottom of the overflow drum delivers the bulk of the overflow stream, the liquid overflow remainder, containing water, liquid hydrocarbons, and coke fines, to an overflow tank 216. A liquid overflow remainder valve 212 in the liquid overflow remainder line 210 controls the flow through the liquid overflow remainder line 210 by the action of a level controller 214, which maintains a constant level in the overflow drum 208.

The overflow tank 216 has sufficient residence time to allow separation of oil, water and coke fines. The oil is skimmed off and sent to the settling drum 124. The water is sent to the quench water tank 140. The coke fines are drained to the coke pit. In the overflow tank 216, the overflow drum bottom stream is collected and temporarily retained, permitting separation of the overflow water and the liquid hydrocarbons. The coke fines separate within the water phase. A coke fines line 228 permits water laden with concentrated coke fines to exit the overflow tank 216 and permits delivery to the coke pit. A coke fines valve 230 is provided in the coke fines line 228 to permit draining of the water laden with concentrated coke fines. In operation, coke fines valve 230 is opened periodically, such as once-per-shift.

In the overflow tank 216, the overflow water is removed from the overflow tank 216 by an overflow water line 232 and provided to the quench water tank 140. Preferably, the overflow water line 232 is positioned appropriately on the side of the overflow tank 216 to draw only overflow water, rather than the liquid hydrocarbons or the coke fines. An overflow water pump 234 may be positioned in the overflow water line 232 to aid in removal of the overflow water from the overflow tank 216 and transmission to the quench water tank 140. An overflow water valve 238 may also be positioned within the overflow water line 232 to terminate flow through the overflow water line 232 when desired. The overflow water valve 238 may be controlled by a flow controller with a level override associated with the overflow tank to avoid a low level in the tank and cavitation of the pump. Overflow water, free of hydrocarbons, is therefore transmitted from the overflow tank 216 to the quench water tank 140 for use in the quench process and to make volume available in the overflow tank 216 for the next overflow operation. The overflow tank 216 is therefore connected to the overflow drum 208 by a liquid overflow remainder line 210 for separating at least one of skim oil, water, coke fines, and tank vapor from the liquid overflow remainder.

As needed, a water-inflow line 218, drawing quench water from the quench water tank 140, may be provided to introduce quench water to the overflow tank 216 to adjust volume in the overflow tank 216 as needed. A water-inflow valve 220 may be provided in the water-inflow line 218 to control the flow through the water-inflow line 218. The water-inflow valve 220 may be controlled manually, or by a flow controller, as well as other control systems known in the art.

In the overflow tank 216, the liquid hydrocarbons, found as skim oil, are removed from the overflow tank 216 by a skim oil line 244 and provided to the settling drum 124. A drawoff tray is located high in the overflow tank 216. As the skim oil is separated from the overflow water, the skim oil collects in the drawoff tray. When the level in the drawoff tray is sufficient, the skim oil is transmitted via the skim oil line 244 and the outlet stream line 123 to the settling drum 124. The determination of sufficiency may be accomplished by a level controller, or by other control systems known in the art. A skim oil pump 240 may be positioned in the skim oil line 244 to aid in removal of the skim oil from the overflow tank 216 and transmission to the settling drum 124. A skim oil flow control valve 248 may also be positioned within the skim oil line 244 to terminate flow through the skim oil line 244 if the level in the overflow tank draw tray is low.

To ensure a vacuum does not arise in the overflow tank 216, a non-air gas, preferably a fuel gas, natural gas, or nitrogen gas, is introduced to the overflow tank 216 by a non-air gas line 256. The non-air gas avoids the potential for air ingress into the system, which prevents the potential for hazardous air-hydrocarbon mixtures, and serves as a vacuum-breaker gas. A non-air gas valve 254, preferably controlled by a pressure controller and set to open on very low pressure, may be provided in the non-air gas line 256 to preclude a vacuum from arising. A non-air gas supply may be provided in communication with the overflow tank 216 together with a non-air gas valve intermediate the non-air gas supply and the overflow tank 216.

Any steam/hydrocarbon vapor, and non-air gas, the tank vapor, exits the overflow tank 216 by a tank vapor line 253 and is communicated to the steam/hydrocarbon vapor line 262 through an overflow ejector 280.

The communication with the overflow ejector 280, ensures overflow tank 216 operates at 0 psig, and therefore reduces the vapor pressure of the liquids in the overflow tank 216, so that when exposed to atmosphere, essentially no vapor is generated.

The overflow ejector 280 is in communication with the steam/hydrocarbon vapor line 262 and the tank vapor line 253, having an inlet in communication with the tank vapor line 253 and an outlet in communication with the steam/hydrocarbon vapor line 262. The overflow ejector 280 reduces the pressure in the overflow tank 216 to 0 psig. The outflow from overflow ejector 280, together with the remaining vapor in the overflow drum vapor line 209 are provided to the blowdown condenser 122 with the content of the overhead hydrocarbon steam stream line 120 to condense the steam and hydrocarbon vapor. Steam, the motive fluid for the overflow ejector 280 is provided from an overflow ejector steam line 266. An overflow ejector steam line valve 270 may be provided in the overflow ejector steam line 266 to open and allow the flow of steam to the overflow ejector 280. The overflow ejector steam line valve 270 is an on/off valve which can be opened and closed from the control room, but may be controlled by other control systems known in the art. The overflow ejector 280 may include a suction pressure controller 291 in communication with the overflow ejector discharge to control pressure in the overflow tank. The setting on this controller can be 0 psig. The suction pressure controller 291 is in communication with the inlet of the overflow ejector 280 and the outlet of the overflow ejector 280, for preventing a vacuum in the tank vapor line 253 and therefore in the overflow tank 216.

An overflow ejector steam line check valve 290 may be positioned in the overflow ejector steam line 266 intermediate the communication from the overflow ejector 280 and the junction with the overhead hydrocarbon steam stream line 120 to prevent backflow from the quench tower 106 to the overflow tank 216 and overflow drum 208.

Figure 3:
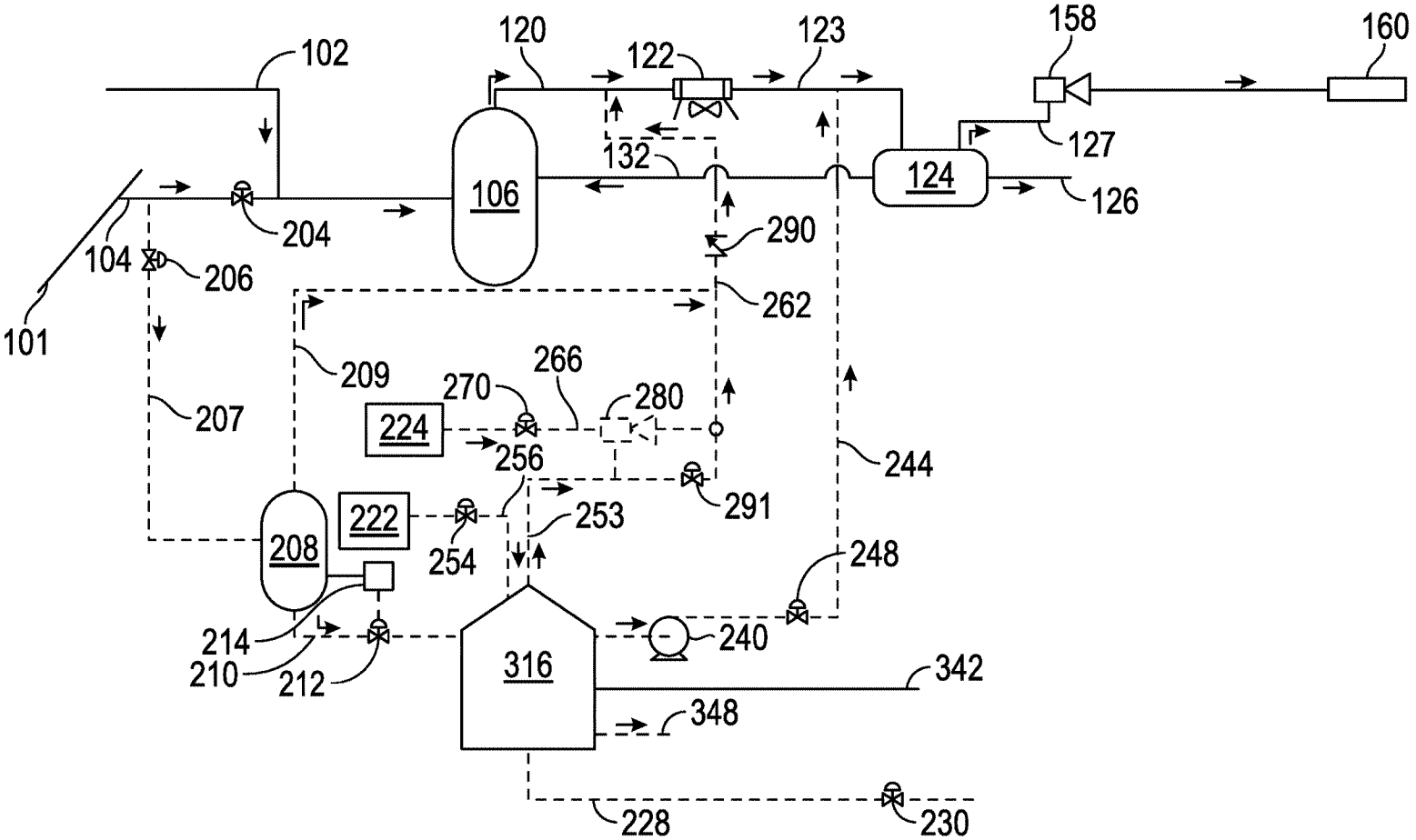
FIG. 3 is a schematic diagram illustrating a conventional delayed coking quench system and another embodiment of a delayed coking quench overflow system according to the present disclosure.

Referring now to FIG. 3, a schematic diagram illustrates a conventional delayed coking quench system and another embodiment of a delayed coking quench overflow system according to the present disclosure.

In another embodiment, the function of the quench water tank 140 is accomplished in a quench water/overflow tank 316, a modification of the overflow tank 216. The quench water/overflow tank 316 includes all elements associated with the overflow tank 216 together than the coke cutting line 342 and a quench water line 348 associated with the quench water tank 140. The overflow water pump 234 and the overflow water line 232, and the water-inflow line 218 and the water-inflow valve 220 shown in FIG. 2 are eliminated.

The delayed coking quench overflow systems illustrated in FIGS. 2-3 effectively minimize atmospheric emissions, which can be applied to delayed coking units that produce shot coke as well as sponge coke. The delayed coking quench overflow systems reduce atmospheric emission of hydrocarbon vapors by flashing off steam and hydrocarbon vapors in an overflow drum—wherein the pressure is reduced by a blowdown ejector to essentially 0-2 psig—and similarly where any remaining hydrocarbon vapors are flashed off from an overflow tank—wherein pressure is reduced to essentially 0 psig from the overflow ejector—to the blowdown condenser.

The present disclosure thus provides a method for reducing the atmospheric emissions of hydrocarbon vapors in a delayed coke drum quench overflow system by producing a vapor overflow remainder and a liquid overflow remainder from the overflow drum 208, separating at least one of skim oil, water, coke fines, and tank vapor from the liquid overflow remainder in the overflow tank 216, transmitting the vapor overflow remainder to the steam line 262, transmitting the tank vapor to an inlet of the overflow ejector 280, and reducing the pressure of the overflow tank 216 to 0 psig. The method may further include introducing water into the overflow drum 208 to maintain a constant level of water in the overflow drum 208 or introducing a non-air gas into the overflow tank 216 to prevent a vacuum in the overflow tank 216. The method may also include positioning a check valve 290 in the steam line 262 to prevent flow from a quench tower 106 to the overflow tank 216 or the overflow drum 208.

Thus, according to the present disclosure, emissions are minimized by recovering all hydrocarbon/steam vapor and oil to the existing blowdown system—a closed system. The overflow ejector 280 reduces the pressure in the overflow tank 216, and the associated tank vapor line 253 to 0 psig. The associated water streams—the coke fines line 228, and the overflow water line 232—are therefore also at 0 psig, eliminating potential vapor when these streams are exposed to atmosphere. Operation of the overflow tank 216, is at the same pressure as the quench water tank 140, which may allow the use of one tank to perform the functions of both an overflow tank and a quench water tank. In addition, the delayed coking quench overflow systems illustrated in FIGS. 2-3 may be retrofitted to conventional delayed coking quench systems.

While the present disclosure has been described in connection with presently preferred embodiments, it will be understood by those skilled in the art that it is not intended to limit the disclosure to those embodiments. For example, it is anticipated that by routing certain streams differently or by adjusting operating parameters, different optimizations and efficiencies may be obtained, which would nevertheless not cause the system to fall outside of the scope of the present disclosure. It is therefore, contemplated that various alternative embodiments and modifications may be made to the disclosed embodiments without departing from the spirit and scope of the disclosure defined by the appended claims and equivalents thereof.

The invention claimed is:

1. A system for reducing atmospheric emissions of hydrocarbon vapors in a delayed coke drum quench overflow system, which comprises:

an overflow drum connected to a blowdown header line for reducing hydrocarbon vapors and producing a vapor overflow remainder and a liquid overflow remainder;

an overflow tank, connected to the overflow drum by a liquid overflow remainder line, for separating at least one of skim oil, water, coke fines, and tank vapor from the liquid overflow remainder;

an overflow drum vapor line in fluid communication with the overflow drum for transmitting the vapor overflow remainder to a steam line; and a tank vapor line in fluid communication with the overflow tank for transmitting the tank vapor to an overflow ejector, wherein the overflow ejector includes an inlet in fluid communication with the tank vapor line and an outlet in fluid communication with the steam line for reducing the pressure in the overflow tank to 0 psig.

2. The system of claim 1, further comprising a suction pressure controller, the suction pressure controller in communication with the inlet of the overflow ejector and the outlet of the overflow ejector, for preventing a vacuum in the tank vapor line.

3. The system of claim 2, further comprising:

a liquid overflow remainder valve in the liquid overflow remainder line and a limit controller associated with the overflow drum and adapted to control the liquid overflow remainder valve for maintaining a constant level in the overflow drum.

4. The system of claim 3, further comprising:

a non-air gas supply in communication with the overflow tank; and a non-air gas valve intermediate the non-air gas supply and the overflow tank for preventing a vacuum in the overflow tank.

5. The system of claim 4, further comprising:

a check valve, the check valve in the steam line intermediate an overhead line, the overhead line intermediate a quench tower and a blowdown condenser, and the overflow drum vapor line, to prevent flow from the quench tower to the overflow tank or the overflow drum.

6. The system of claim 5, further comprising:

a steam supply in connection with the overflow tank; and an overflow ejector valve intermediate the steam supply and the overflow ejector to open a flow of steam to the overflow ejector.

7. The system of claim 1, further comprising:

an overflow line in communication with the overflow tank and a quench water tank for communicating water from the overflow tank to the quench water tank.

8. The system of claim 7, further comprising:

an overflow line valve in the overflow line for limiting a flow of water through the overflow water line.

9. The system of claim 8, further comprising:

a coke cutting line connected to the quench water tank;

a quench water line connected to the quench water tank;

a water in-flow line from the quench water line to the overflow tank; and a water inflow valve in the water in-flow line, intermediate the quench water line and the overflow tank, for adjusting a volume of water in the overflow tank.

10. The system of claim 1, further comprising:

a coke cutting line connected to the overflow tank; and a quench water line connected to the overflow tank.

11. A method for reducing atmospheric emissions of hydrocarbon vapors in a delayed coke drum quench overflow system, which comprises:

producing a vapor overflow remainder and a liquid overflow remainder from an overflow drum;

separating at least one of skim oil, water, coke fines, and tank vapor from the liquid overflow remainder in an overflow tank;

transmitting the vapor overflow remainder to a steam line;

transmitting the tank vapor to the steam line through an overflow ejector; and reducing the pressure of the overflow tank to 0 psig.

12. The method of claim 11, further comprising:

introducing water into the overflow drum to maintain a constant level of water in the overflow drum.

13. The method of claim 12, further comprising:

introducing a non-air gas into the overflow tank to prevent a vacuum in the overflow tank.

14. The method of claim 13, further comprising:

positioning a check valve in the steam line to prevent flow from a quench tower to the overflow tank or the overflow drum.

* * * * *